United States Patent [19]

DeSanto

[11] 4,412,467

[45] Nov. 1, 1983

[54] CYLINDER-MOUNTED CUTTER

[75] Inventor: Ronald F. DeSanto, Palos Hills, Ill.

[73] Assignee: Lehigh Steck Warlick, Broadview, Ill.

[21] Appl. No.: 301,947

[22] Filed: Sep. 14, 1981

[51] Int. Cl.[3] ..... B26D 1/62

[52] U.S. Cl. ..... 83/346; 83/348; 83/663; 83/698

[58] Field of Search ..... 83/348, 346, 347, 674, 83/663, 698

[56] References Cited

U.S. PATENT DOCUMENTS

| | | | |
|---|---|---|---|
| 2,341,503 | 2/1944 | Bombard | 83/346 X |
| 2,682,306 | 6/1954 | Schriber | 83/346 |
| 3,257,885 | 6/1966 | Hornung | 83/348 X |
| 3,555,948 | 1/1971 | Olson | 83/346 X |
| 3,828,637 | 8/1974 | Slack | 83/674 X |
| 3,857,314 | 12/1974 | Gregoire | 83/674 X |
| 4,366,737 | 1/1983 | Bedford | 83/348 X |

*Primary Examiner*—James M. Meister

*Attorney, Agent, or Firm*—Trexler, Bushnell & Wolters, Ltd.

[57] ABSTRACT

Mechanism for cutting a traveling printed web comprises a base adapted for mounting on a cylinder and a cutting die adapted to be mounted on the base. The cutting die cooperates with the anvil on an anvil cylinder for cutting the web. An elastomeric sheet is interposed between the base and the die and is yieldable within its elastic limits to displace the cutting edge toward the base as the cutting edge engages the anvil during the cutting operation.

3 Claims, 6 Drawing Figures

CYLINDER-MOUNTED CUTTER

BACKGROUND OF THE INVENTION

This invention relates to improved cylinder-mounted cutters for printing presses, more particularly a cutoff mechanism for cutting a traveling web into a number of pieces subsequent to printing on the web.

Mechanisms of the type with which the present invention is concerned comprise a rotary knife that cooperates with an anvil to cut the traveling printed web into a number of individual production pieces. Generally speaking the rotary knife or die cutter is mounted upon a rotating cylinder and cooperates with a second rotating cylinder upon which the anvil is mounted. The cutting edge or edges of the knife and the working surface of the anvil rotate at the same peripheral speed and the cut is made as a cutting edge moves into and out of engagement with the surface of the anvil.

Since the cutting action of the knife against the anvil involves metal against metal, there is a relatively high amount of knife wear, thereby resulting in necessity for frequent knife replacement. Moreover, the setup or "make ready" time for knife replacement is substantial. In this regard the knife or cutting die, as it is sometimes called, is mounted on a base member which, in turn, is mounted on the rotatable cylinder. The attachment of the knife to the base is generally through a multiplicity of bolts which must hold the knife in a precise position for proper engagement with the anvil. Typically it is necessary to mount the knife on to the base and then tighten down on the bolts to provide a coarse adjustment for the position of the knife. The anvil and knife cylinders are then rotated until the knife engages the anvil causing the knife to set itself in the proper position. Thereafter, each of the bolts holding the knife to the base is precisely tightened to a specified torque to hold the knife in its final or adjusted position.

OBJECTS AND SUMMARY OF THE INVENTION

An object of this invention is to provide an arrangement for mounting the cutting die in such a manner that the need for precise application of torque to a substantial number of mounting bolts holding the knife to the base is eliminated.

A further object of this invention is to provide a cutting mechanism in which the make-ready or setup time is substantially reduced, thereby reducing the cost of manufacture of the printed product.

A further object of this invention is to provide an arrangement for mounting a cutter which reduces the amount of knife wear at the cutting edge or edges, thereby eliminating the need for frequent removal and replacement of the knife.

In accordance with the foregoing objects the invention comprises a mechanism for cutting a traveling web into a number of pieces subsequent to printing on the web, said mechanism comprising a die cylinder assembly and a cooperating anvil cylinder assembly, two assemblies being rotatable about parallel axes in time relation to the travel of the web therebetween, said anvil cylinder assembly having an anvil on its periphery, said die cylinder assembly comprising a die cylinder, a base member mounted on the periphery of said cylinder, a cutting die carried by said base member radially outwardly thereof and having at least one radially outwardly presented cutting edge for engagement with said anvil to cut the web repeatedly, and a resilient sheet of elastomeric material on one of said assemblies and yielding within its elastic limits as said cutting edge engages said anvil to take up relative radial movement between the cutter and anvil during the cutting operation.

In accordance with the preferred form of the invention the elastomeric sheet is interposed between the die and the base to allow a radial displacement of the die during the cutting action. The sheet preferably has Shore A hardness of about 75–80.

DETAILED DESCRIPTION

Figure 1:
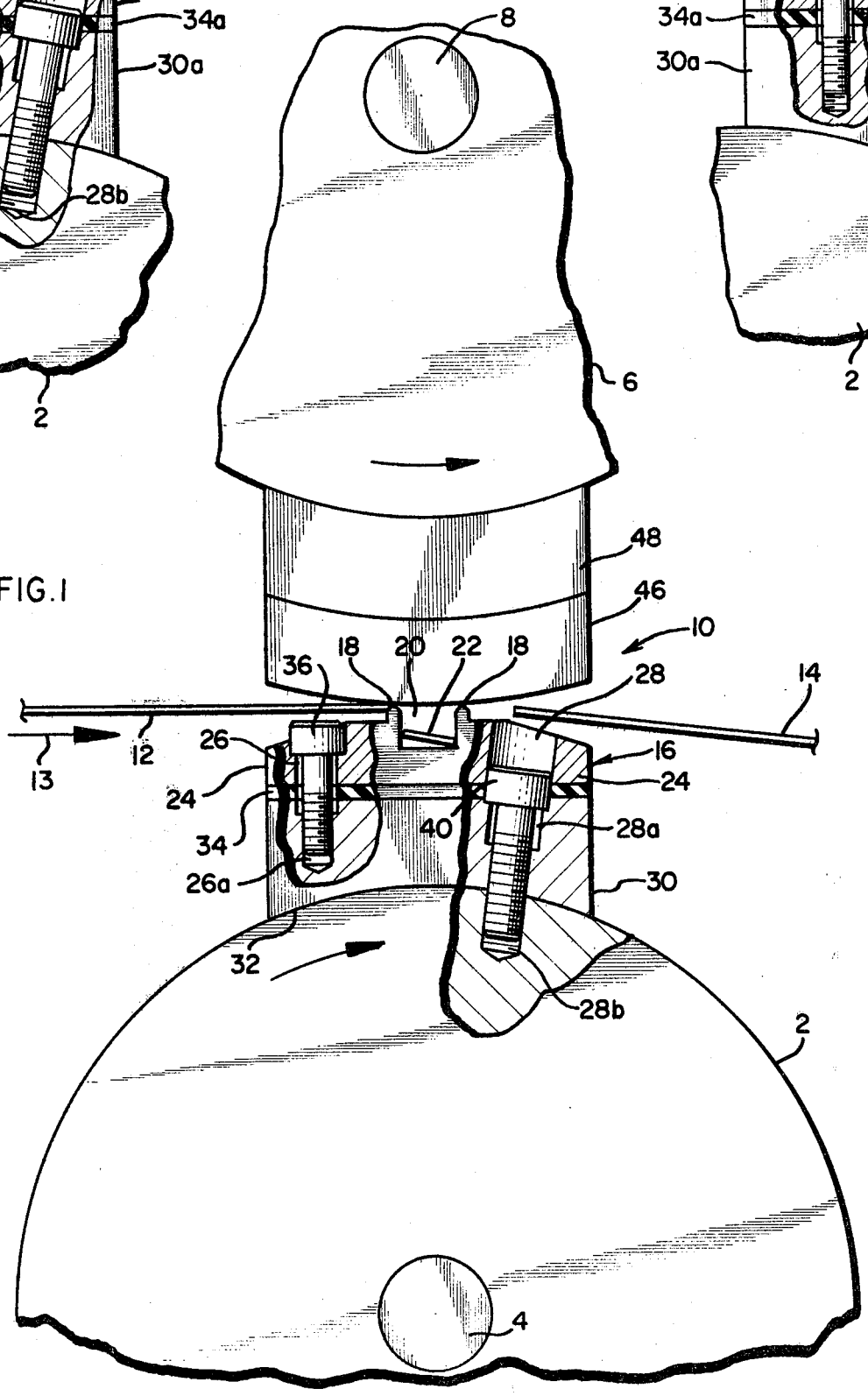
FIG. 1 is a fragmentary elevational view, partially broken away and in section, showing a mechanism embodying a dual cutting edge die and constructed in accordance with the present invention.
Figure 2:
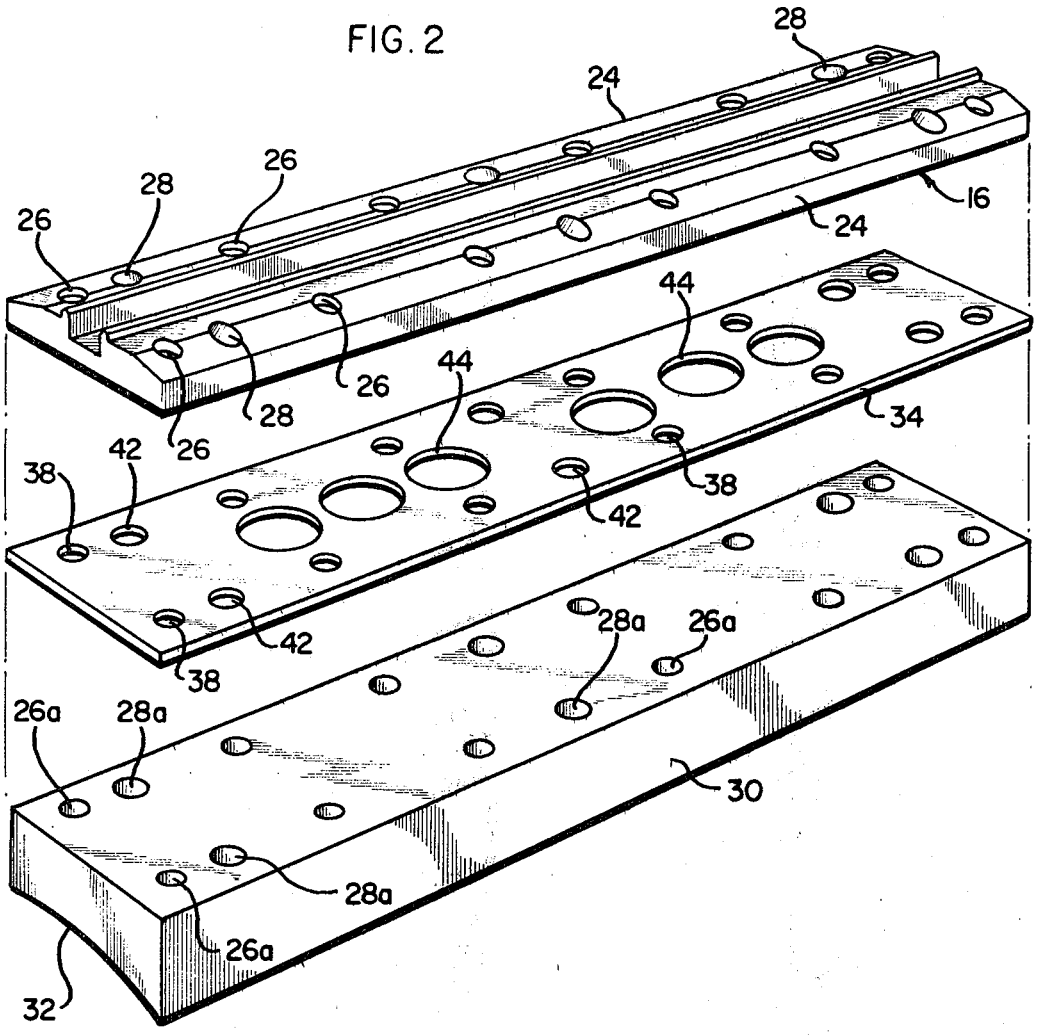
FIG. 2 is an exploded perspective view of the cutting die, elastomeric sheet, and base which form parts of the present invention.
Figure 5:
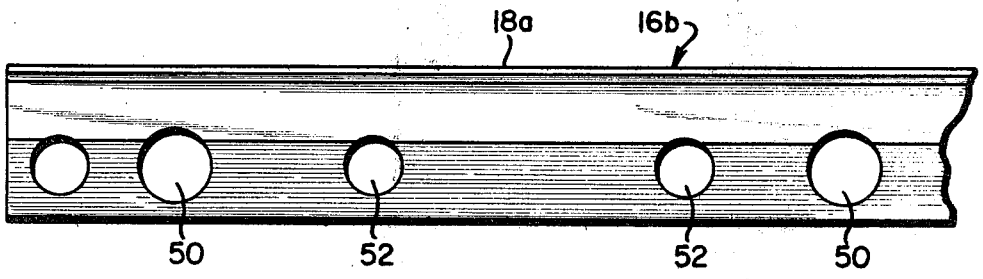
FIG. 5 is a fragmentary top plan view and showing approximately one-half of the cutting die of FIGS. 3 and 4.
Figure 6:
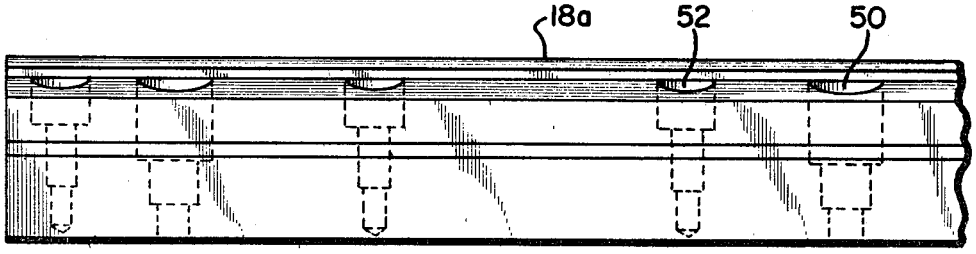
FIG. 6 is a side elevational view of the structure of FIG. 5.

Referring now to the drawing and particularly to FIGS. 1 and 2 there is shown a knife cylinder 2 having a shaft 4. There is also a cooperating anvil cylinder 6 having a shaft 8. The shafts 4, 8 are parallel so that the cylinders 2, 6 rotate in opposite directions about parallel axes whereby a printed web 12 traveling in the direction of arrow 13 is cut into a multiplicity of work pieces 14, there being one piece cut off for each revolution of the cylinders 2, 6.

The cutting mechanism 10 comprises a knife or die 16 that includes parallel knives 18, 18 which are spaced apart to define a valley or channel 20. Since the cutting edges of both knives 18 cut the web 12 there will be a trim strip 22 of waste material which will be cut off from the web 12. The dual knife die 16 finds use where it is desirable to cut the finished product so that printed material, such as an illustration, will be bled at one edge of the finished product 14.

The cutting die 16 comprises lateral flanges 24, 24 projecting oppositely from the channel 20. These flanges 24, 24 are provided with two groups of holes 26, 26, etc. and 28, 28, etc. on opposite sides of the channel 20. The first group of holes 26 is disposed such that their central axes form a plane substantially parallel to the cutting knives 18. The holes 28 etc. are aligned such that their central axes form a plane that is in an angle to the cutting knives 18 as best seen in FIG. 1.

Provided for supporting the die 16 is a base member 30 having an inner curved surface 32 that fits comformably against the surface of the cylinder 2. However, in accordance with this invention, a resilient elastomeric sheet 34 is interposed between the die 16 and the base member 30. In a preferred form of the invention the sheet 34 is substantially coextensive with the die 16 and base 30 and is formed of a polyurethane resin having a thickness of about one-eighth of an inch and a hardness of about 75–80 on the Shore A scale.

The die 16 is secured to the base 30 by bolts 36 which project through clearance holes 38 in the sheet 34 and into tapped holes 26*a* in the base 30. There is a like group of bolts 36 through each flange 24, 24, the arrangement through one of the flanges being shown in FIG. 1. A second group of bolts 40 projects through holes 28 and into aligned holes 28*a* in the base 30 and also into threaded holes 28*b* in the cylinder 2 so as to anchor the base 30 to the cylinder 2. It will be appreciated that like groups of bolts 40, one on each flange 24, will be utilized, one such arrangement being shown in FIG. 1. Clearance holes 42 are formed in the elastomeric sheet 34 for the bolts 40. Preferably the sheet 34 has a series of cutouts 44 to enhance its resiliency. Thus, the heads of bolts 40 retain the base 30 snugly on the cylinder 2 while the heads of bolts 36 hold the die 16 against the sheet 34, at the same time permitting a small amount of radially inward movement of the die 16 against the force of the resilient sheet 34.

The die 16, base 30 and sheet 34 are mounted on the cylinder 2 so that the cutting edges of the die 16 engage the surface of an anvil 46 during each revolution of the cylinder 2, 6. The anvil 46 may be conventionally mounted on a suitable anvil support 48. If necessary one or more shims may be interposed between the die 16 and the base 30 to effect proper adjustment of the die cutting edges. The elastomeric sheet 34 is of considerable significance so far as concerns the cutting operation as it allows the die 16 to move radially toward and away from the surface of the anvil 46 to take up the radial forces imposed upon the die 16 during the cutting operation. The radial displacement of the die 16 is only of the order of 0.003 inches but this is within the elastic limits of the sheet 34 and is sufficient to insure a clean cutting of the web while at the same time reducing the wear on the cutting edges of the knives 18 over that wear which would present were the sheet 34 not used. The setup time for precision mounting of the die assembly onto the cylinder 2 is also reduced and accurate torque-loading of the mounting bolts 36, 40 is not required.

Figure 3:
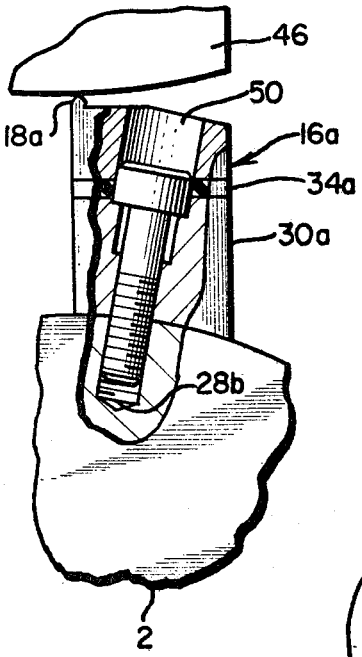
FIGS. 3 and 4 are fragmentary elevational views, partially broken and in section, and showing a modified form of cutting die, namely one which has a single cutting edge rather than dual edges as shown in FIGS. 1 and 2.
Figure 4:
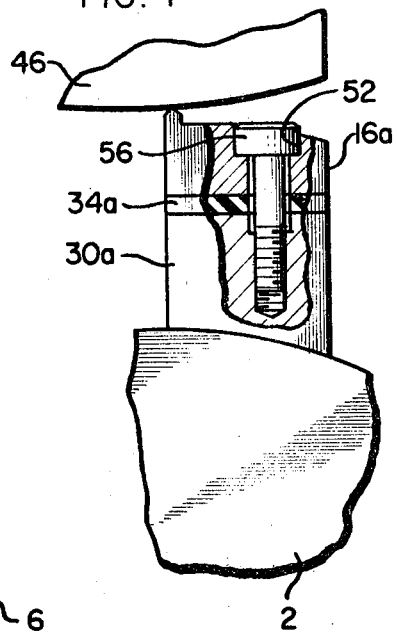

The form of the invention shown in FIGS. 3–6 is similar in principle to that shown in FIGS. 1 and 2. However, the cutting die 16*a* has only one cutting knife 18*a* at one side thereof for engaging the outer arcuate peripheral surface of the anvil 46. The base member 30*a* is secured to the cylinder 2 by bolts 54 which thread into tapped holes 28*b* in the cylinder 2. Clearance for the heads of bolts 54 are provided by clearance holes 50 in the die 16 and in a like hole in the elastomeric strip 34*a*, as best seen in FIG. 3. Referring to FIG. 4 it will be seen that screws 56 secure the die 16*a* to the base 30*a*. These screws are received in holes 52 and companion holes in the elastomeric strip 34*a*. The screws 56 thread into threaded holes in the base member 30*a*. Thus, the arrangement permits a small amount of radial displacement of the die 16*a* against the elastic force of the sheet 34*a*.

The invention is claimed as follows:

1. In a printing press, a cut-off mechanism for cutting a traveling web into a number of pieces sebsequent to printing on the web, said mechanism comprising a die cylinder assembly and a cooperating anvil cylinder assembly, the two assemblies being rotatable about parallel axes in timed relation to the travel of the web therebetween, said anvil cylinder assembly having an anvil on its periphery, said die cylinder assembly comprising a die cylinder, a base member mounted on the periphery of said die cylinder, a first group of fasteners projecting through the base member and threaded into the die cylinder for securing the base member to the die cylinder, a cutting die carried by said base member radially outwardly thereof and having at least one radially outwardly presented cutting edge for engagement with said anvil to cut the web repeatedly, a resilient sheet of elastomeric material interposed between said die and said base and yielding within its elastic limits as said cutting edge engages said anvil to take up relative radial displacement between the cutter die on the one hand and said anvil and base member on the other hand during the cutting operation, and a second group of fasteners, separate and distinct from said first group, projecting through said die and resilient sheet and threaded into said base member to secure the die to the base member entirely by the applied torque of said second group of fasteners, said second group of fasteners causing said die to impose compressive pressure on said sheet.

2. In a printing press according to claim 1, said sheet having a Shore A hardness of about 75–80.

3. Cutting mechanism according to claim 1 in which said sheet has cut-outs that enhance the resiliency of the sheet.

* * * * *